United States Patent [19]

Ishigure

[11] Patent Number: 4,638,746

[45] Date of Patent: Jan. 27, 1987

[54] DEVICE FOR AUTOMATICALLY OPENING AND CLOSING CASH CONTAINER

[75] Inventor: Kazuaki Ishigure, Kyoto, Japan

[73] Assignee: Omron Tateisi Electronics Co., Kyoto, Japan

[21] Appl. No.: 734,664

[22] Filed: May 16, 1985

[30] Foreign Application Priority Data

May 19, 1984 [JP] Japan ..... 59-101603

[51] Int. Cl.[4] ..... E05G 1/04

[52] U.S. Cl. ..... 109/52; 109/66; 232/43.2; 232/15

[58] Field of Search ..... 109/52, 66, 45; 232/12, 232/15, 43.1, 43.2, 43.4

[56] References Cited

U.S. PATENT DOCUMENTS 3,016,185 1/1962 Osborne ..... 232/15
3,841,550 10/1974 Kaneda et al. ..... 232/15
4,186,977 2/1980 Gilovich et al. ..... 109/52 X
4,552,075 11/1985 Glasson et al. ..... 109/52

*Primary Examiner*—Carl D. Friedman
*Attorney, Agent, or Firm*—Stevens, Davis, Miller & Mosher

[57] ABSTRACT

A device for automatically opening and closing the cash inlet-outlet opening of a cash container which is detachably installable into a rack in a cash handling apparatus. The device comprises a shutter provided inside the container and slidable along a wall thereof for opening or closing the opening; opening-closing drive means including opening and closing stoppers mounted on the rack and a knob attached to the shutter and cooperative with the stoppers, the drive means being adapted to drive the shutter with the movement of the container when the container is installed into or removed from the rack; lock means for holding the opening closed with the shutter; and release means for undoing the lock means with the movement of the container when the container is installed into the rack.

7 Claims, 9 Drawing Figures

DEVICE FOR AUTOMATICALLY OPENING AND CLOSING CASH CONTAINER

BACKGROUND OF THE INVENTION

The present invention relates to a device for automatically opening or closing the cash inlet-outlet opening of a cash container when the container is installed into or removed from a cash handling apparatus such as an automatic depositing-payment machine, automatic money changing machine or the like.

The term "cash" as herein used refers chiefly to bills but is to be interpreted also as meaning coins and sheets of paper having some value, such as cards and valuable securities.

A cash container is necessary for accommodating the cash received by cash handling apparatus and for dispensing the cash to be delivered from the apparatus. To replenish the apparatus with the cash to be delivered and to withdraw the received cash from the apparatus, the cash container is removably inserted into the apparatus. The container has a cash inlet-outlet opening and a shutter for opening and closing the opening.

To render the container easy to handle and to prevent wrongful act of the clerk who handles the container, it is desirable that the cash inlet-outlet opening of the container be automatically openable or closable with the shutter when the container is installed into or removed from the cash handling apparatus. It is further desirable that the inlet-outlet opening of the container can be held closed with the shutter by a lock and that the shutter can be automatically released from the lock upon the installation of the container into the apparatus.

SUMMARY OF THE INVENTION

The main object of the present invention is to provide a device by which the cash inlet-outlet opening of a cash container can be automatically opened or closed when the container is installed into or removed from a cash handling apparatus and which is adapted to automatically lock the opening in closed state and to unfasten the lock only when the container is attached to the apparatus.

For use in a system wherein a cash container having a cash inlet-outlet opening is detachably installable into a rack provided in a cash handling apparatus, the present invention provides a device for automatically opening and closing the cash container which device is characterized in that it comprises a shutter provided inside the container and slidable along a wall thereof for opening or closing the opening; opening-closing drive means including opening and closing stoppers mounted on the rack and a knob attached to the shutter and cooperative with the stoppers, the drive means being adapted to drive the shutter with the movement of the container when the container is installed into or removed from the rack; lock means for holding the opening closed with the shutter; and release means for undoing the lock means with the movement of the container when the container is installed into the rack.

With use of the above device, the shutter closing the inlet-outlet opening of the cash container is opened upon the installation of the container into the cash handling apparatus, while the opening is closed with the shutter upon the removal of the container from the apparatus. The shutter can be held in its opening closing position by the lock, which is not unfastened unless the container is re-installed into the apparatus. Thus, the cash container is made easy to handle and will not permit wrongful act of the clerk who handles the container.

DESCRIPTION OF THE PREFERRED EMBODIMENT

The drawings show a device embodying the present invention for a bill container for use in a bill handling apparatus such as an automatic depositing-payment machine or an automatic money changing machine.

Figure 1:
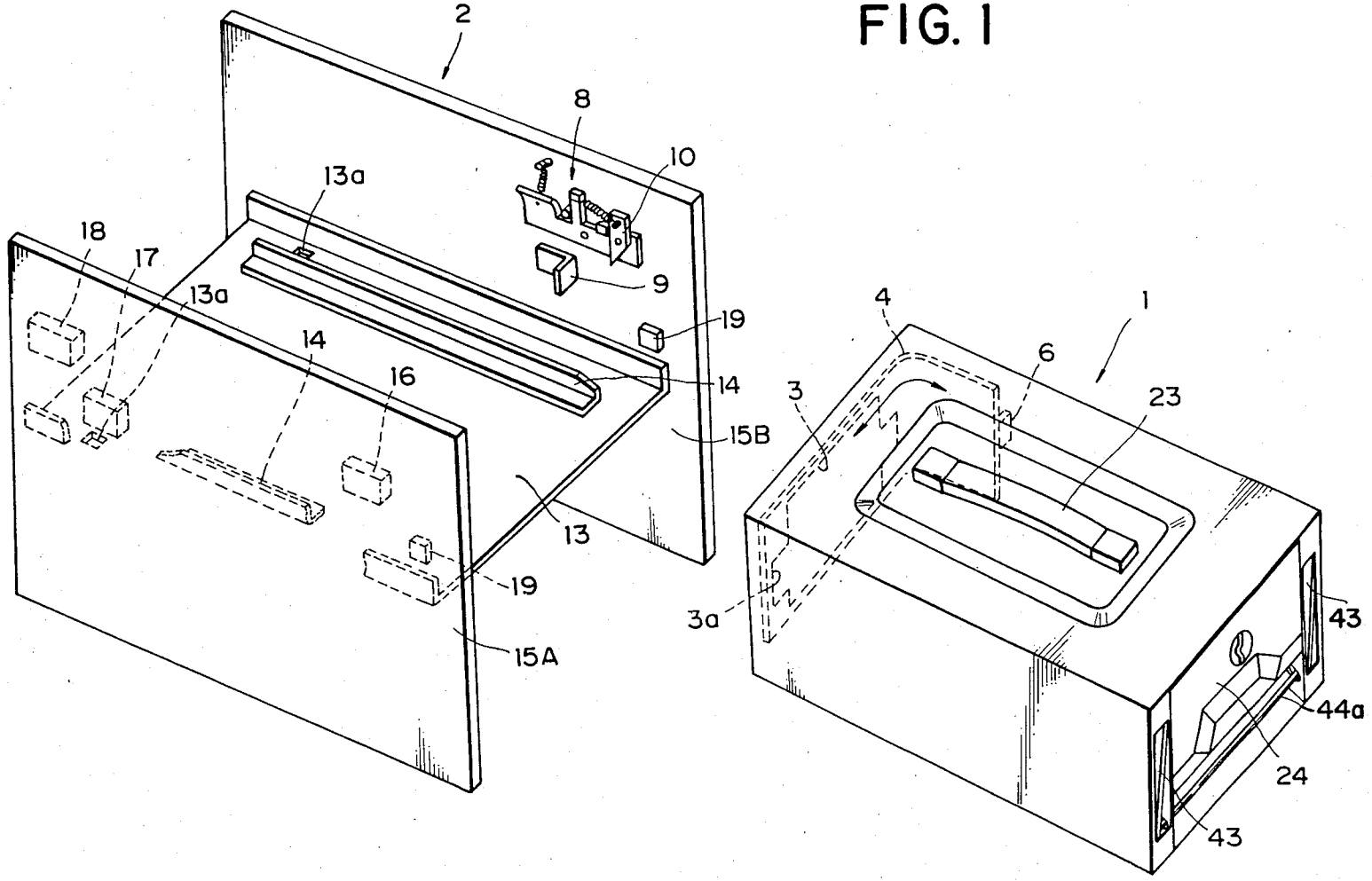
FIG. 1 is a perspective view showing a bill container and a rack in which the container is to be installed.

With reference to FIG. 1, the bill handling apparatus is internally provided with a rack 2 for placing a bill container 1 therein. The rack 2 comprises two vertical plates 15A, 15B and a horizontal plate 13 extending between and interconnecting these vertical plates. Two rails 14 extending along opposite sides of the horizontal plate 13 are fixedly mounted on the plate 13. The rails 14 extend in a direction in which the container 1 is removably installed into the rack 2. A positioning hole **13*a* is formed in the rearmost portion of the horizontal plate 13 and is positioned at the outer side of each rail 14. One of the vertical plates, 15A, is provided on its inner surface with a sensor 18 positioned toward the rear end of the plate for detecting absence of bills and a shortage of bills, and with a sensor 16 positioned toward the front end of the plate for detecting that the container is full of bills. The plate 15A further has a positioning sensor 17 to the front of sensor 18 slightly therebelow. Each of the vertical plates 15A, 15B is provided on its inner surface with an unlocking permanent magnet 19** at a front lower portion.

An opening stopper 9 and a closing stopper 10 are attached to the inner surface of the other vertical plate 15B at a sightly upper front portion. The stopper 9, which is fixed to the plate 15B is positioned slightly below and slightly inward from the stopper 10. The stopper 10 is included in a pivotal assembly 8.

Figure 2:
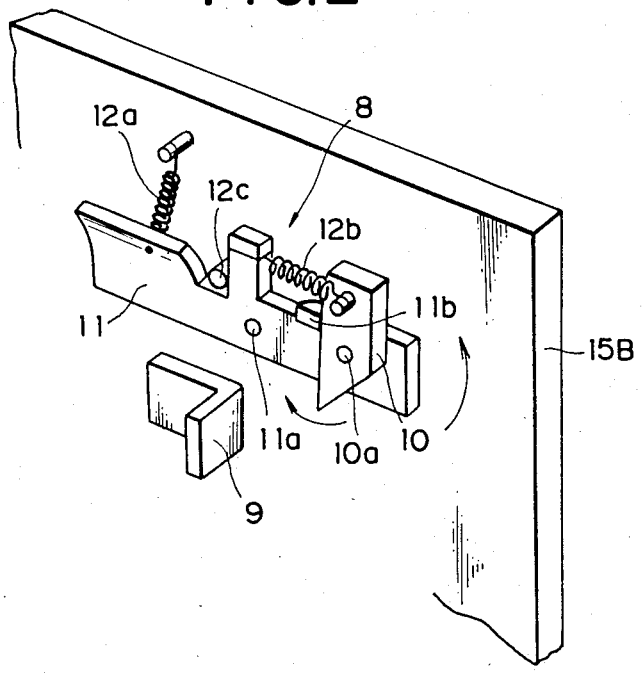
FIG. 2 is an enlarged perspective view showing a pivotal assembly including a closing stopper.

FIG. 2 shows the pivotal assembly 8 in detail. The pivotal assembly 8 comprises a support member 11 pivoted to the vertical plate 15B by a pin **11*a*. The stopper 10 is pivoted to one end of the support member 11 by a pin 10*a*. The other end of the support member 11 is biased upward by a tension spring 12*a*. A stop pin 12*c* fixed to the plate 15B holds the member 11 in a substantially horizontal position. The stopper 10, although biased at its upper end by a tension spring 12*b*, is held in a substantially vertical position by contact with an engaging piece 11*b* which is formed by bending a portion of the support member 11. The force of the spring 12*a*** is greater than that of the spring 12*b*. The stopper 10 and the support member 11 are pivotally movable in the directions shown by arrows against the action of the springs 12*b*, 12*a*, respectively.

Figure 3:
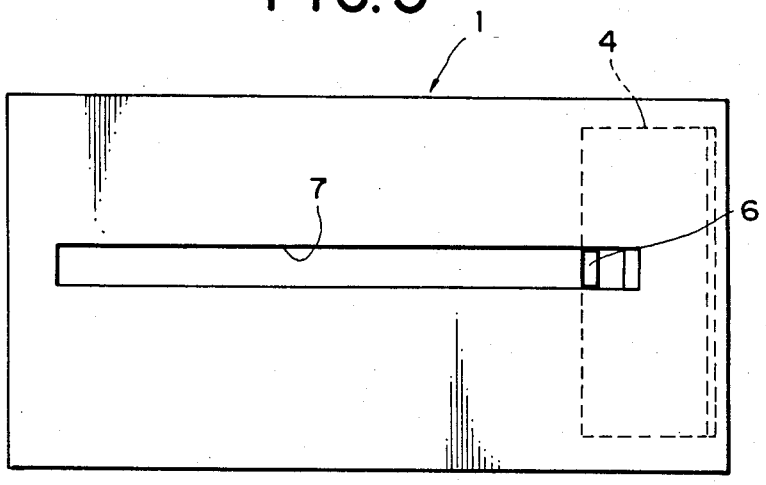
FIG. 3 is a side elevation showing the bill container.

With reference to FIG. 1 again, a bill inlet-outlet opening 3 is formed in the rear wall of the bill container 1. At opposite sides of the opening 3, the container rear wall is formed with cutouts 3*a* through which the bill drawing-in bars 40 to be described later advance or retract. A shutter 4, which is in the form of a flexible plate, is slidable along upper and lower guides (not shown) provided inside the rear wall and a side wall (side plate 1*d*) of the container 1. An opening-closing knob 6 projecting from one side edge of the shutter 4 extends outward through a horizontal slit 7 formed in the side plate 1*d* of the container 1 (see FIG. 3).

The container 1 has a band 23 on its upper side for carrying the container and a lockable door 24 at its front side. Bills can be placed into or taken out from the container 1 by opening the door 24.

Figure 4:
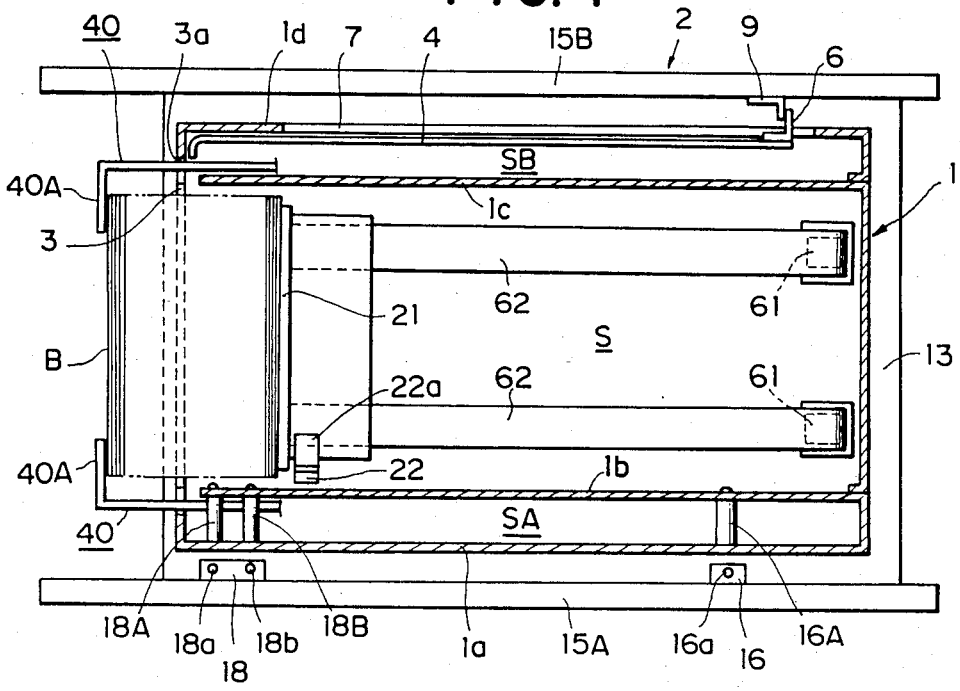
FIG. 4 is a view in horizontal section showing the bill container as placed in the rack.
Figure 5:
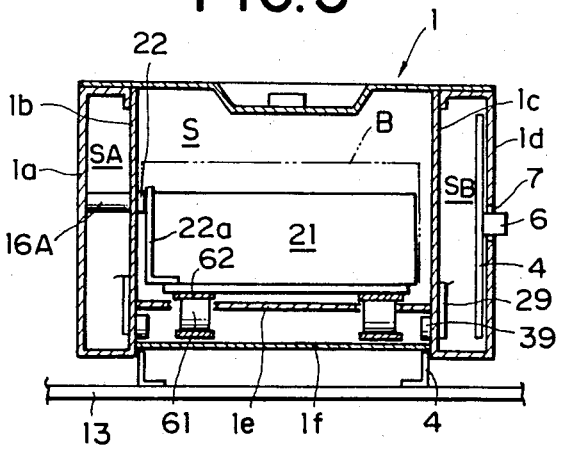
FIG. 5 is a view in vertical section showing the same.

FIGS. 4 and 5 generally show the interior construction of the bill container 1. The container 1 is shown as placed in the rack 2.

Inner side plates 1*b*, 1*c* are provided inside the side plates 1*a*, 1*d* of the container 1, respectively, at a suitable distance therefrom. The inner side plates 1*b*, 1*c* define a space S therebetween for accommodating bills. The shutter lock assembly to be described later is housed in each of the space SA between the side plate 1*a* and the inner side plate 1*b* and the space SB between the side plate 1*d* and the inner side plate 1*c*. The space SB serves also as a space for accommodating the shutter 4 when the opening 3 is open.

A bottom cover 1*f* is provided under and spaced apart from the bottom plate 1*e* of the container 1. The bottom plate 1*e* and the bottom cover 1*f* are at slightly higher levels than the bottoms of the spaces SA, SB. A pair of opposite pulleys 61 supported by a shaft is disposed in the space between the bottom plate 1*e* and the bottom cover 1*f* at each of the front and rear ends of the container 1. Two belts 62 are reeved around these pulleys 61. The pulleys 61 project slightly above the bottom plate 1*e* through holes formed therein to position the upper side of each belt 62 above the bottom plate 1*e*. A vertically upstanding member 21 for bills to bear on extend across and is attached to the belts 62. When the container 1 is installed in the rack 2, the pulleys 61 are driven by drive means in the bill handling apparatus through a suitable coupling mechanism (not shown), whereby the position of the bearing member 21 is adjusted in accordance with the quantity of bills within the space S.

A bracket 22*a* fixed to the bill bearing member 21 extends toward the inner side plate 1*b* and then vertically upward. A permanent magnet 22 is fixed to the upper end of the bracket 22*a*. The aforementioned bill absence and bill shortage sensor 18 includes reed switches 18*a* and 18*b* for detecting absence of bills and a shortage of bills, respectively. Magnetic path members 18A and 18B, which are magnetically permeable, are provided between the side plate 1*a* and the inner side plate 1*b* at locations where these members are opposed to the reed switches 18*a* and 18*b* when the container 1 is placed into the rack 2 (also see FIG. 6). The magnet 22 is at the same level as these members 18A. 18B. Accordingly, the reed switch 18*a* is actuated when the magnet 22 is brought to the position of the member 18A, and the reed switch 18*b* is actuated when the magnet is opposed to the member 18B. Similarly the sensor 16 for detecting that the container is full of bills includes a reed switch 16*a*, and a magnetic path member 16A is disposed in corresponding relation thereto. The positioning sensor 17 also includes a reed switch, which is actuated by the permanet magnet 36 to be described later.

Figure 6:
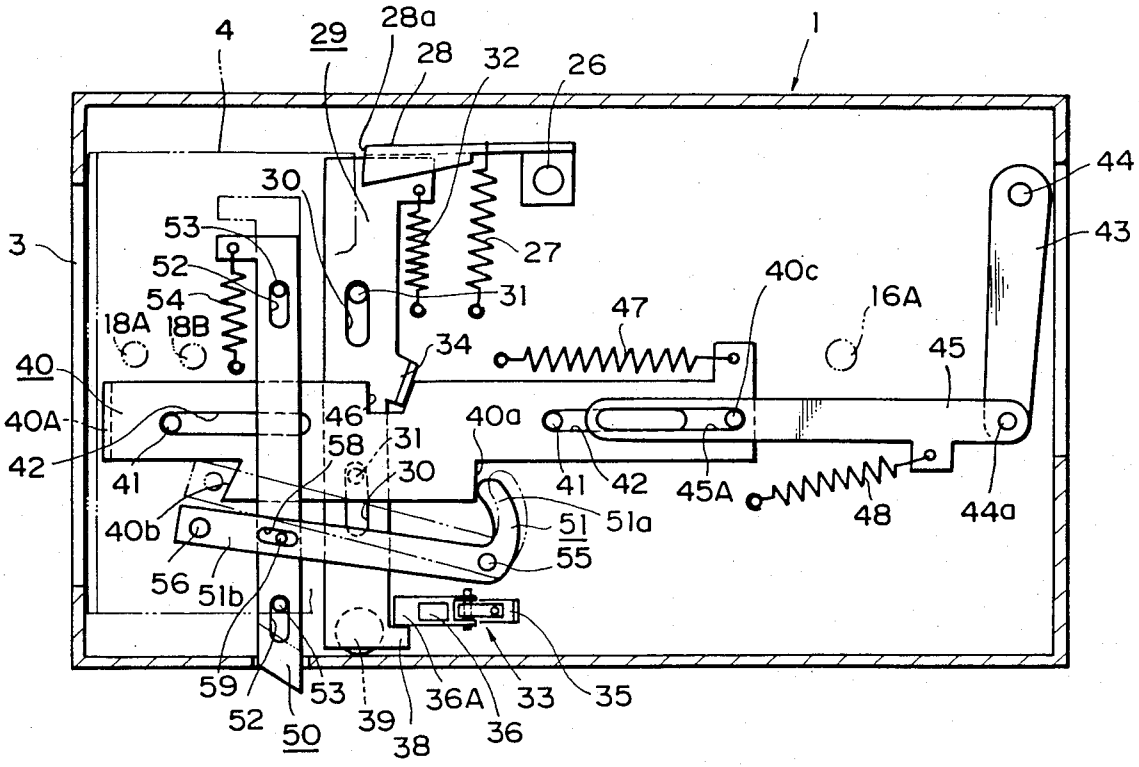
FIG. 6 shows a shutter lock assembly in its entirety while locking the shutter.
Figure 7:
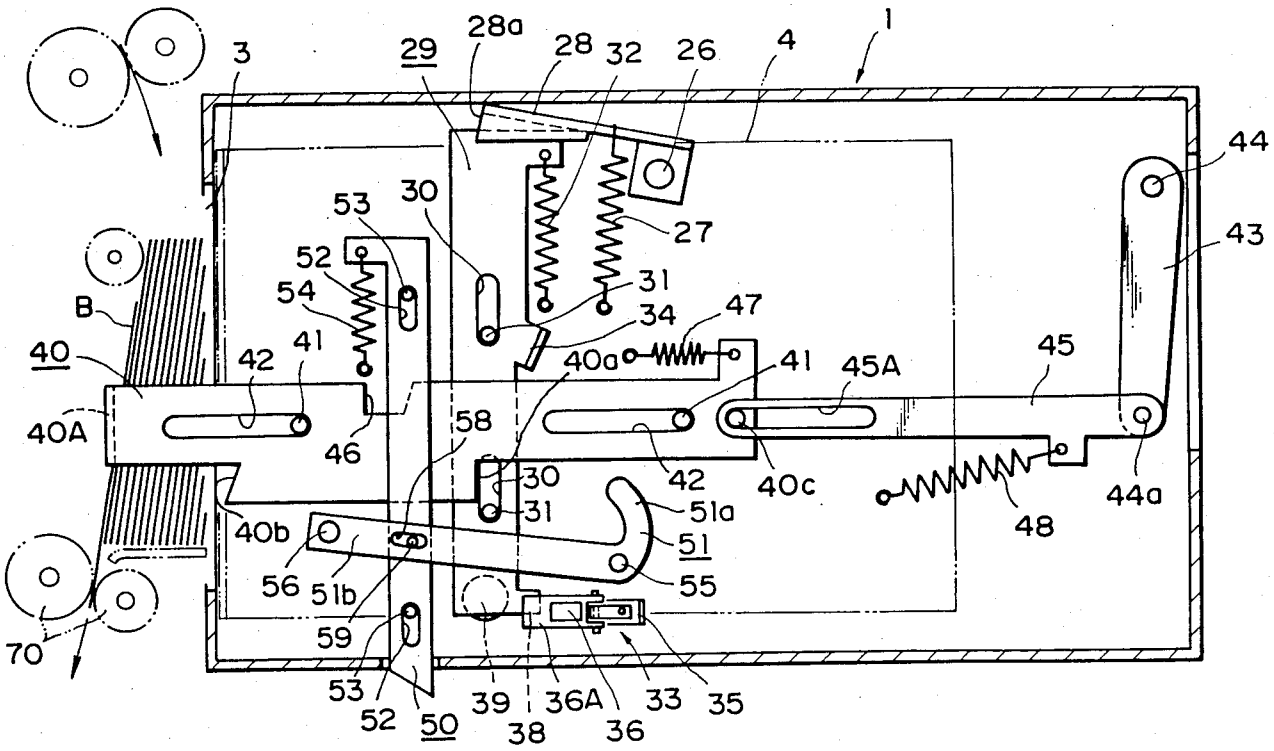
FIG. 7 shows the same as it is undone.

The above-mentioned shutter lock assembly is provided in each of the spaces SA and SB at opposite sides of the bill container 1 as seen in FIG. 6 or 7. The lock assembly in the space SA and the lock assembly in the space SB have exactly the same construction except that the assembly in the space SB only has a lock lever 28. Accordingly, the construction of only one of the lock assemblies will be described below.

With reference to FIG. 6 or 7, the lock lever 28, a slider 29, an auxiliary slider 50, the bill drawing-in bar 40, a pivotal lever 51 and a handle lever 43 are supported by pins 26, 31, 53, 41, 55 and 44, respectively, which are secured to the side plate 1*a* (or 1*d*) or the inner side plate 1*b* (or 1*c*) of the container 1.

The slider 29 has two slots 30, in which the pins 31 are inserted, whereby the slider 29 is vertically movably supported. The slider 29 has engaging projections 34 and 38 at its midportion and lower end, respectively. A roller 39 is rotatably attached to the lower end of the slider 29. The shaft of the roller 39 is movable in a vertically elongated slit formed in the inner side plate 1*b* (1*c*) and is positioned between the bottom plate 1*e* and the bottom cover 1*f* to position the roller 39 in the bottom space. The bottom cover 1*f* has a hole for passing the roller 39 therethrough to a projected position below the bottom cover 1*f* (see FIGS. 5, 8 and 9). The slider 29 is biased downward by a tension spring 32.

Figure 8:
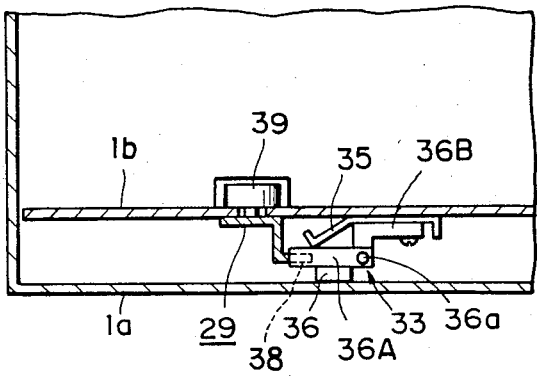
FIG. 8 is an enlarged view in horizontal section showing a slider lock assembly while locking the slider.
Figure 9:
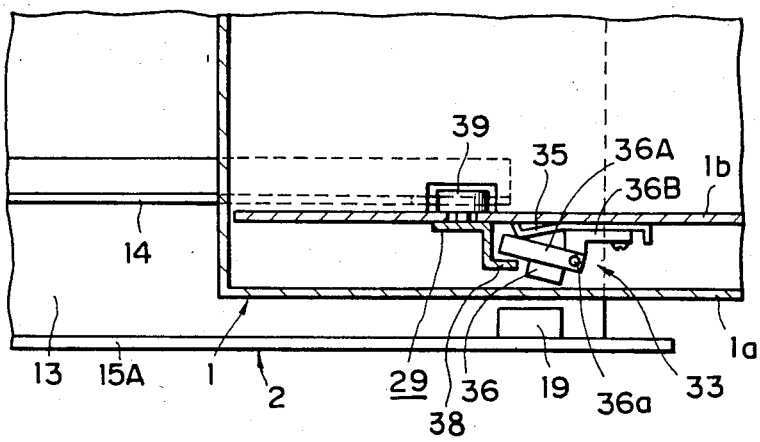
FIG. 9 is a view similar to FIG. 8 and showing the same as it is undone.

FIGS. 8 and 9 show a slider lock assembly 33 for restraining the slider 29 from moving upward. A lock piece 36A is horizontally movably pivoted by a pin 36*a* to a bracket 36B fixed to the inner side plate 1*b* (1*c*). The above-mentioned permanent magnet 36 is secured to the outer side of the lock piece 36A. The lock piece 36A is biased outward by a plate spring 35.

Referring to FIGS. 6 or 7 again, the lock lever 28 for locking the shutter 4 as positioned to close the inlet-outlet opening 3 of the container 1 is supported by the pin 26 so as to be pivotally movable upward or downward and is biased by a tension spring 27 in a direction to urge a lock end 28*a* thereof downward. The lock lever 28 has a horizontal portion which bears on the upper end of the slider 29.

The drawing-in bar 40 has two slots 42 in which the pins 41 engage, whereby the bar 40 is held horizontally movable. The bar 40 has an inwardly bent finger 40A at its outer end (see FIG. 4). The bar 40 has an engaging recess 46 at the midportion of its upper side and a downard projection at the middle portion of its lower side. The projection has engaging stepped portions 40*a*, 40*b* at its opposite ends. The drawing-in bar 40 is biased toward the finger 40A by a tension spring 47.

The auxiliary slider 50 is vertically movably supported by the pins 53 engaging in slots 52 formed therein and is biased downward by a tension spring 54. A hole is formed in the bottom plate to render the lower end of the slider 50 projectable below the container 1.

The pivotal lever 51 is pivotably supported by the pin 55 and comprises an arcuate portion 51*a* and a straight portion 51*b*. An engaging pin 56 is attached to the free end of the straight portion 51*b*. The pivotal lever 51 is formed with a slot 58 having engaged therein a pin 59 on the auxiliary slider 50, whereby the pivotal lever 51 is coupled to the auxiliary slider 50.

The handle lever 43 is pivotably supported at its upper end by the pin 44. The levers 43 within the two spaces SA and SB are interconnected by a connecting rod 44*a* at their lower ends. The connecting rod 44*a* extends through a recess at the front side of the container 1 (see FIG. 1). A connecting bar 45 is connected at its one end to the lower end of the lever 43. The other end of the connecting bar 45 is formed with a slot 45A having engaged therein a pin 40*c* on the drawing-in bar 40, whereby the connecting bar 45 is coupled to the drawing-in bar 40. The connecting bar 45 is biased by a tension spring 48 toward the bar 40.

The state of the bill container 1 before it is placed into the rack 2 is best shown in FIGS. 6 and 8. In this state, each slider 29 is held in a lowered position by the action of the spring 32. With the projection 34 of the slider 29 engaged in the recess 46 of the bill drawing-in bar 40, the bar 40 is held in a retracted position against the force of the spring 47. Each lock piece 36A, which is biased outward by the plate spring 35, is in engagement with the upper side of the projection 38 at the lower end of the slider 29 to lock the slider 29 against upward movement. Although the roller 39 is slightly projected beyond the bottom surface (bottom cover 1*f*) of the container 1, the slider 29 will not move even if the roller is pushed by hand. The lock lever 28 is held in position by the force of the spring 27 with the lock end 28*a* retained in its lowered position in engagement with one side edge of the shutter 4, thus locking the shutter 4. Because the slider 29 is locked, the shutter 4 will not be unlocked.

When the container 1 is progressively placed into the rack 2, the lower ends of the auxiliary sliders 50 first come into contact with the horizontal plate 13, which in turn pushes the auxiliary sliders 50 upward against the force of the springs 54. With this movement, the pivotal levers 51 move about the pins 55, bringing the pins 56 thereon into engagement with the stepped portions 40*b* of the drawing-in bars 40 (see the auxiliary slider and the pivotal lever indicated in broken lines in FIG. 6).

Subsequently, the magnets 36 within the container 1 reach the position where they are opposed to the magnets 19 fixed to the vertical plates 15A, 15B of the rack 2, whereupon the repellent force acting between the opposed magnets inclines the lock pieces 36A inward against the force of the plate springs 35, thereby unlocking the sliders 29 (see FIG. 9).

The rollers 39 then ride onto the rails 14 on the horizontal plate 39, raising the unlocked sliders 29 against the action of the springs 32. The upper end of one of the sliders 29 therefor strikes against and pushes up the lock lever 28, which is therefore moved about the pin 26 to lift its lock end 28*a*. This unlocks the shutter 4. The upward movement of the sliders 29 disengages their projections 34 from the recesses 46 of the drawing-in bars 40, but the engagement of the pins 56 on the pivotal lever 51 with the stepped portions 40*b* of the bars 40 holds the bars 40 in their retracted position.

In the meantime, the opening-closing knob 6 on the shutter 4 strikes against the stopper 10 on the vertical wall 15B of the rack 2 and then passes under the stopper 10 while slightly rotating the stopper 10 against the action of the spring 12*b*.

As the container 1 is further inserted into the rack 2, the knob 6 on the shutter 4 strikes against the stopper 9, which in turn moves the shutter 4 with the insertion of the container 1, progressively opening the inlet-outlet opening 3.

When the container 1 is brought to a specified position on the rack 2, the lower ends of the auxiliary sliders 50 held pushed up by the rack horizontal plate 13 reach the location of the positioning holes 13*a*, whereupon the springs 54 move the sliders 50 to fit their lower ends into the holes 13*a*. This moves the pins 56 out of engagement with the stepped portions 40*b*, permitting the springs 47 to project the drawing-in bars 40 outward beyond the opening 3. FIG. 7 shows this state. At this time, the shutter 4 leaves the opening 3 completely open. With the magnet 36 opposed to the sensor 17, the sensor 17 detects that the container 1 is installed in place.

With the container 1 completely installed in the rack 2, bills B are delivered from the container 1 by rollers 70, etc. and bills B are transported from above to the front of the inlet-outlet opening 3.

To remove the container 1 from the rack 2, the connecting rod 44*a* is pulled toward the front first, whereby the connecting bars 45 are moved rightward in FIG. 7 against the action of the springs 48. Since the drawing-in bars 40 are thereby moved in the same direction, the bills B in front of the opening 3 are taken into the container 1 through the opening 3 by the fingers 40A at the outer ends of the bars 40.

The movement of the drawing-in bars 40 brings the stepped portions 40*a* thereof into contact with the arcuate portions 51*a* of the pivotal levers 51, moving the levers 51 about the pins 55 to raise the pins 56 into engagement with the stepped portions 40*b*. The movement of the pivotal levers 51 raises the auxiliary sliders 50 and moves their lower ends out of the positioning holes 13*a*.

As the container 1 is withdrawn, the knob 6 on the shutter 4 strikes against the stopper 10, acting to rotate the stopper 10, which nevertheless is prevented from rotation by the contact of an upper portion of the stopper 10 with the engaging piece 11*b*. With the knob 6 in contact with the stopper 10, the shutter 4 is moved relative to the container in a direction to close the opening 3 as the container 1 is withdrawn.

When the opening 3 has been completely closed with the shutter 4, the rollers 39 are brought out of contact with the rails 14, whereupon the sliders 29 descend under the action of the springs 32, engaging the projections 34 in the recesses 46 of the drawing-in bars 40. The lock lever 28 is also returned to the original position by the force of the spring 27 to lock the shutter 4 in the opening closing position. The lock pieces 36A, which are biased outward by the plate springs 35, engage with the projections 38 on the sliders 28 to lock the sliders 38.

When the container 1 is pulled out with a great force, with the knob 6 in bearing contact with the stopper 10, the support member 11 is pivotally moved about the pin 11*a* against the action of the spring 12*a*, releasing the knob 6 from the stopper 10, whereupon the container 1 is completely removed from the rack 2.

What is claimed is:

1. A device for automatically opening and closing a cash container having an opening, comprising:

a rack provided within a cash handling apparatus for receiving the cash container therein, a shutter provided inside the cash container and slidable along a wall thereof for opening and closing the opening, a knob attached to the shutter and projecting outward from the cash container, an opening stopper engageable with the knob when the container is installed into the rack and a closing stopper engageable with the knob when the container is withdrawn from the rack, the stoppers being attached to a side plate of the rack, a shutter lock lever engageable with a side edge of the shutter when the shutter is in its opening closing position and retainable in the engaging position by a first spring, the lever being provided within the cash container, a slider provided slidably within the cash container for shifting the lock lever from the engaging position against the first spring, a lock piece engageable with a portion of the slider for holding the slider immovable and provided with a first magnet, the lock piece being held in the slider engaging position by a second spring, and a second magnet attached to the rack and operable on the first magnet when the cash container is installed into the rack to shift the lock piece from the slider engaging position.

2. A device as defined in claim 1 further comprising a pivotal assembly, the pivotal assembly comprising:

a support member pivoted to the side plate of the rack, the support member being biased by a spring and held in a horizontal position by a stop pin, and said closing stopper pivoted to an end portion of the support member, the closing stopper being biased by a spring and held in a substantially vertical position by an engaging piece.

3. A device as defined in claim 1 further comprising:

an auxiliary slider projectable at its lower end into a positioning hole formed in a horizontal plate of the rack when the cash container is installed in place on the rack, the auxiliary slider being holdable in the projected position by a spring, and a handle lever for raising the auxiliary slider from the positioning hole.

4. In a system including a cash container having an opening and means for removably receiving the cash container therein, a device for automatically opening and closing the cash container comprising:

opening-closing means movably provided in the cash container for opening and closing the opening, opening-closing drive means comprising first means mounted on the receiving means and second means attached to the opening-closing means and cooperative with the first means, the drive means being adapted to drive the opening-closing means with the movement of the cash container when the container is placed into or removed from the receiving means, lock means for holding the opening-closing means in its opening closing position by engaging with the opening-closing means, and release means for undoing the lock means with the movement of the cash container, the release means comprising third means provided on the receiving means and fourth means provided within the container for releasing the engagement between the lock means and the opening-closing means in cooperation with the third means when the container is placed into the receiving means.

5. A device as defined in claim 4, further comprising means for retaining the lock means in its released position in cooperation with the third means when the container is placed in the receiving means.

6. A device as defined in claim 4, further comprising means for fixing the container in its installed position within the receiving means by engaging with a portion of the receiving means when the container is placed into the receiving means.

7. A device as defined in claim 6, further comprising means for causing the container to be movable by releasing the fixing means from the engagement with the portion of the receiving means.

* * * * *